US009534834B1

(12) United States Patent
Klassen

(10) Patent No.: US 9,534,834 B1
(45) Date of Patent: Jan. 3, 2017

(54) ELEVATING SHELF SYSTEM

(71) Applicant: Leighton Klassen, La Salle (CA)

(72) Inventor: Leighton Klassen, La Salle (CA)

( * ) Notice: Subject to any disclaimer, the term of this patent is extended or adjusted under 35 U.S.C. 154(b) by 7 days.

(21) Appl. No.: 14/672,264

(22) Filed: Mar. 30, 2015

Related U.S. Application Data

(60) Provisional application No. 61/983,686, filed on Apr. 24, 2014.

(51) Int. Cl.

| | |
|---|---|
| ***A47F 1/04*** | (2006.01) |
| ***A47F 7/00*** | (2006.01) |
| ***A47F 5/08*** | (2006.01) |
| ***A47F 5/00*** | (2006.01) |
| ***A47B 53/00*** | (2006.01) |
| ***A47B 43/00*** | (2006.01) |
| ***A47B 47/00*** | (2006.01) |
| ***A47B 57/00*** | (2006.01) |
| ***F25D 25/02*** | (2006.01) |
| ***A47B 57/06*** | (2006.01) |
| ***A47B 96/02*** | (2006.01) |
| ***A47B 46/00*** | (2006.01) |
| ***A47B 45/00*** | (2006.01) |
| ***A47F 3/06*** | (2006.01) |
| ***A47F 1/12*** | (2006.01) |

(52) U.S. Cl.
CPC ..... *F25D 25/024* (2013.01); *A47B 45/00* (2013.01); *A47B 46/00* (2013.01); *A47B 57/06* (2013.01); *A47B 96/021* (2013.01); *A47B 96/025* (2013.01); *A47F 1/125* (2013.01); *A47F 3/06* (2013.01); *A47F 5/0081* (2013.01)

(58) Field of Classification Search
CPC ..... F25D 25/024; F25D 25/08; F25D 25/00; F25D 25/022; A47B 96/021; A47B 57/06; A47B 96/02; A47B 96/025; A47B 57/00; A47B 45/00; A47B 46/00; A47B 57/30; A47F 1/00; A47F 1/04; A47F 1/125; A47F 1/126; A47F 1/06; A47F 3/02; A47F 3/06; A47F 5/0043; A47F 5/0081; A47F 5/10; A47F 2005/0075; B65G 1/07; B65G 1/0464; B65G 1/06
USPC ..... 211/1.3, 59.3, 175, 187, 190, 207, 153,211/119.003; 108/50.11, 65, 147.12, 136; 312/408, 306, 312, 319.1, 319.4; 62/3.6, 62/251, 329
See application file for complete search history.

(56) References Cited

U.S. PATENT DOCUMENTS 642,561 A * 1/1900 Phillips ..... A47F 5/10 211/175
1,590,296 A * 6/1926 Klein ..... A47B 9/10 108/106

(Continued)

*Primary Examiner* — Jennifer E Novosad
(74) *Attorney, Agent, or Firm* — Robert C. Montgomery; Montgomery Patent & Design, LLC

(57) ABSTRACT

An elevating shelf system having a shelf assembly with a three-sided frame, a top panel and a bottom panel that fits inside an open-top enclosure. Also included is a lifting assembly. The shelf assembly can be raised or lowered within the enclosure while the lifting assembly imparts an upward vertical force on the shelf assembly to make lifting easier. Attached in the frame are channel shaped brackets which hold extendable shelves. The lifting assembly includes friction adjustable struts which are protected by side walls of the enclosure. The top panel includes a lifting handle as well as a transparent inventory holder for retaining an inventory of items in the elevating shelf system. The elevating shelf system also includes a locking mechanism to look the shelf assembly at a desired height.

17 Claims, 7 Drawing Sheets

(56) References Cited

U.S. PATENT DOCUMENTS 1,896,846 A * 2/1933 Knight ..... F25D 25/00 211/153
2,116,564 A * 5/1938 D Olive ..... F25D 25/02 312/310
2,319,872 A * 5/1943 Leonard ..... B65D 7/06 211/59.3
2,448,171 A * 8/1948 Campbell ..... A61F 17/00 206/803
2,549,664 A * 4/1951 Collins ..... F25D 25/00 312/310
3,797,272 A 3/1974 Huey
4,132,458 A 1/1979 Leek
4,214,684 A * 7/1980 Galowitz ..... A63B 47/00 206/315.9
4,422,554 A 12/1983 Lichti
5,299,863 A * 4/1994 Albright, Jr. ..... F25D 25/024 312/404
6,336,692 B1 * 1/2002 Snyder ..... F24C 15/027 312/306
6,742,855 B2 6/2004 Whitaker et al.
6,877,826 B2 * 4/2005 Wood ..... A47B 45/00 108/110
6,959,824 B1 * 11/2005 Alperson ..... A47F 5/137 211/1.3
7,107,779 B2 9/2006 Avenwedde et al.
7,451,603 B2 11/2008 Tuszkiewicz et al.
7,757,870 B2 * 7/2010 Lin ..... C25D 17/08 211/118
7,850,411 B2 12/2010 Solomon
8,135,482 B2 * 3/2012 Caldwell ..... A47B 57/00 211/119.003
8,322,804 B2 12/2012 Kim
2007/0199334 A1 * 8/2007 MacNair ..... F25D 25/04 62/3.6
2010/0117499 A1 * 5/2010 Fortier ..... A45C 7/0031 312/306
2010/0231105 A1 * 9/2010 Latif ..... A47B 46/005 312/293.1
2013/0055604 A1 * 3/2013 Herman Baran ..... A47B 45/00 40/606.03
2013/0320832 A1 * 12/2013 Ward ..... B01L 9/00 312/408
2013/0320833 A1 * 12/2013 Ward ..... F25D 23/02 312/408
2015/0323244 A1 * 11/2015 Marts ..... F25D 25/024 312/408
2015/0330701 A1 * 11/2015 Roullett ..... F25D 25/022 211/85.4
2016/0037913 A1 * 2/2016 Franck ..... A47B 57/20 211/208

* cited by examiner

ELEVATING SHELF SYSTEM

RELATED APPLICATIONS

This application claims the benefit of U.S. Provisional Application No. 61/983,686, which was filed Apr. 24, 2014, the entire disclosures of which are incorporated herein by reference.

FIELD OF THE INVENTION

The presently disclosed subject matter is directed to storage shelving. More particularly, it is directed to a shelf-based storage system for chest freezers.

BACKGROUND OF THE INVENTION

One (1) of the best and easiest ways to preserve food is by freezing. Many homes and businesses rely on chest-style freezers to preserve and store food in a safe manner that protects the taste and texture of the food. Such freezers are simple in concept, cost efficient to produce, are relatively inexpensive to operate and can be large enough to store a significant amount of food.

While chest freezers have proven their worth they are not without faults. Perhaps the biggest fault with chest freezers is the difficulty encountered in locating and removing a certain food item from within the large confines of the freezer. Over time smaller food items tend to gravitate towards the bottom of the freezer compartment. Thus a user may have to remove many large, heavy items just to locate one (1) particular smaller item. While this may be a rather minor task to some to the elderly, disabled, short, or those suffering from an injury such a task can be a major task or even something impossible to perform. Additionally, smaller food items can become lost within the freezer and not be found until past their expiration date. This causes waste and inconvenience.

Accordingly, there exists a need for a way that food items contained within a chest style freezer can be located quickly and easily. Preferably such a way would enable easy access to food within a chest style freezer even for the elderly, disabled, short, or those suffering from an injury. It would be beneficial if the way to enable access is quick, easy, and effective.

SUMMARY OF THE INVENTION

The principles of the present invention provide for a shelving system for chest freezers that enable all food items within a freezer to be located quickly and easily even by the elderly, disabled, short, or those suffering from an injury. The inventive shelving system can be implemented in a cost effective manner and in a way that fits many different chest freezers.

An elevating shelf system in accord with the present invention includes a shelf assembly having a frame that forms surfaces along three (3) sides, a top panel attached to the top of the frame and a bottom panel attached to the bottom of the frame. The shelf assembly further includes at least two (2) brackets attached within the frame. An extendable shelf is held by the at least two (2) brackets. Also included is an enclosure for receiving the shelf assembly and a lifting assembly operatively connected to the shelf assembly and to the enclosure. The shelf assembly can be raised or lowered within the enclosure while the lifting assembly imparts an upward vertical force on the shelf assembly.

The elevating shelf system may include a handle on the top panel as well as a transparent inventory holder affixed to the top panel for retaining an inventory of items in the elevating shelf system. The frame may be comprised of welded metal wire and the top panel and the bottom panel may be solid, flat plates. The shelf assembly beneficially forms an open-front, five-sided box. Preferably the at least two (2) brackets are channel-shaped and the extendable shelf is held within the channels.

The enclosure may be comprised of welded metal wire and the enclosure beneficially takes the form of a five-sided open-top box having a base. The lifting assembly can include at least one (1), elongated and vertically orientated spring loaded strut that imparts an upward force on the shelf assembly. In that case the enclosure might include a side panel having a semi-circular strut guard which partially encircles the strut.

The elevating shelf system beneficially includes at least one (1) anchor for connecting the enclosure to an interior wall of a chest freezer. The anchor may then include a suction cup assembly having a suction cup for attaching to the interior wall and a connector for connecting to the enclosure. Preferably there may be at least one (1) clip for connecting the enclosure to an adjacent enclosure. If so, the clip is beneficially a "J"-shaped appendage.

The lifting assembly might also include a lift base that is attached to the bottom of the strut. That strut can include a manually adjustable friction collar for enabling an adjustable controlled ascent and descent of the shelf assembly. The strut might include a first strut tube having an internal spring, a second strut tube having a strut piston, a first mounting foot attached to the base and a second mounting foot attached to the shelf assembly.

The elevating shelf can further including a latch assembly having a housing that is attached to the enclosure. The latch assembly can then further include a movable lock-bolt that passes through the housing and into the frame, to secure the shelf assembly at a desired height. The lock-bolt may be spring biased toward the shelf assembly.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
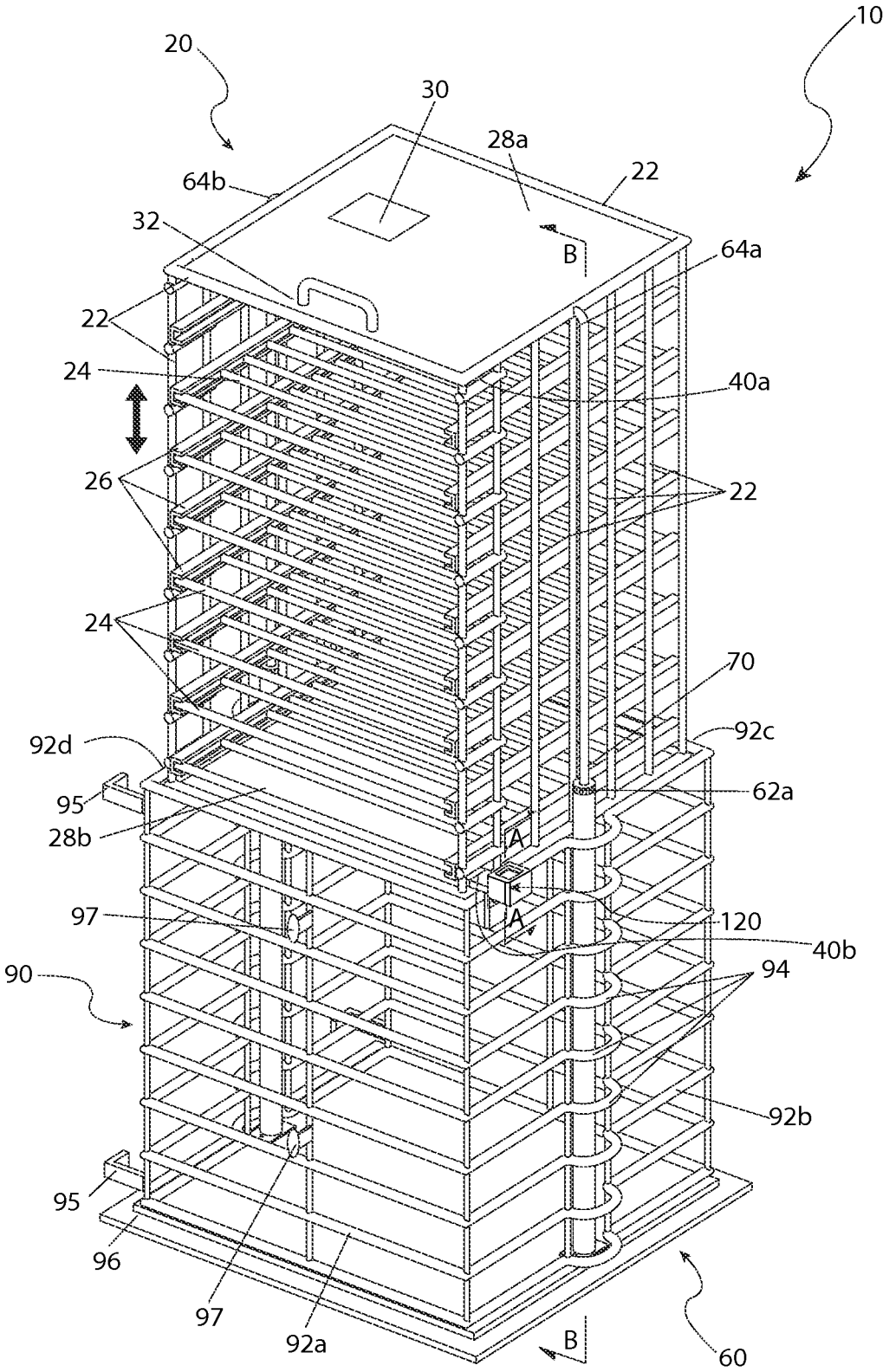
FIG. 1 is a front perspective view of an elevating shelf system 10 that is in accord with a preferred embodiment of the present invention.

10 elevating shelf system
20 shelf assembly

22 frame
24 shelf
25 cross-member
26 bracket
28*a* top panel
28*b* bottom panel
30 plastic sleeve
32 handle
40*a* first latch aperture
40*b* second latch aperture
60 lifting assembly
61*a* first strut tube
61*b* second strut tube
62*a* first strut
62*b* second strut
64*a* first strut shaft
64*b* second strut shaft
66*a* first mounting foot
66*b* second mounting foot
68 lift assembly base
70 friction collar
72 strut spring
74 strut piston
90 enclosure
92*a* front panel
92*b* first side panel
92*c* rear panel
92*d* second side panel
94 strut guard
95 joining clip
96 enclosure base
97 anchor
120 latch assembly
122 latch housing
124 push-button
126 lock-bolt
127*a* first cam
127*b* second cam
128 spring
200 fastener

DETAILED DESCRIPTION OF THE PREFERRED EMBODIMENT

The preferred embodiment of the present invention is depicted within FIGS. 1 through 6. However, the invention is not limited to what is specifically illustrated and described. A person skilled in the art will appreciate that many other embodiments of the invention are possible without deviating from the basic concept of the invention. Any such work around also falls with the scope of this invention.

The terms "a" and "an" herein do not denote a limitation of quantity, but rather denote the presence of at least one (1) of the referenced items. In addition, unless otherwise denoted all directional signals such as up, down, left, right, inside, outside are taken relative to the illustration shown in FIG. 1.

The present invention describes an elevating shelf system 10 which provides shelving for use within a chest-type freezer. The elevating shelf system 10 rises vertically out of the freezer, thereby making access to internal contents easier.

Referring now to FIG. 1, the elevating shelf system 10 provides a shelf assembly 20, a lifting assembly 60, and an enclosure 90. The shelf assembly 20 includes a welded metal wire frame 22 forming flat rectangular surfaces along three (3) sides, a solid flat top panel 28*a* and a solid flat bottom panel 28*b*. The top panel 28*a* and bottom panel 28*b* are respectively affixed to the frame 22 along its top and bottom perimeter edges. The result is an open-front five-sided box-like structure. The frame 22 supports horizontally extendable shelves 24 that are stacked vertically within the frame 22. The shelves 24 are positioned in and slide along channel-shaped brackets 26 (also see FIG. 4).

The shelf assembly 20 is envisioned as being approximately thirty inches (30 in.) in height, sixteen inches (16 in.) in width, and sixteen inches (16 in.) in depth. The top panel 28*a* includes a plastic sleeve 30 or another type of transparent inventory holder that is adhesively or otherwise affixed thereto. The plastic sleeve 30 allows a user to document the contents at the particular locations and the various categories of items located upon the shelves 24. A user may note the contents and location of a food item on a card or on a similar media which is then inserted into the transparent plastic sleeve 30 for easy viewing upon opening the freezer door.

Referring now to FIGS. 1, 2*a*, 2*b* and 3 the shelf assembly 20 may be raised and locked in position to access the shelves 24. To assist lifting the shelf assembly 20 the lifting assembly 60 includes an attached pair of struts 62*a*, 62*b*. The struts 62*a* and 62*b* are spring-loaded dampening mechanisms shown in cut-away in FIG. 6 and described in more detail subsequently. The struts 62*a*, 62*b* exert an upward force on the upper sides of the shelf assembly 20 thereby enabling a user to easily lift the shelf assembly 20 to access its contents such as foodstuffs or other items that stored in a freezer.

Referring back to FIG. 1, the shelf assembly 20 is protectively positioned within a rigid box-shaped enclosure 90. The enclosure 90 provides a protective barrier between the shelf assembly 20 and other contents in the freezer which might interfere with the vertical movement of the shelf assembly 20 during raising or lowering. The enclosure 90 is a wire frame construction similar to that of the shelf assembly 20. It has five (5) sides including a front panel 92*a*, a first side panel 92*b*, a rear panel 92*c*, a second side panel 92*d*, and an enclosure base 96.

The side panels 92*b*, 92*d* include integral semi-circular strut guards 94 which surround and protect the struts 62*a*, 62*b* of the lifting assembly 60 from the freezer contents. The front panel 92*a* stabilizes the elevating shelf system 10, especially in the raised state, via a plurality of joining clips 95 and anchors 97. The joining clips 95 are "J"-shaped appendages capable of hooking and joining respective enclosures 90 when more than one (1) unit of the elevating shelf system 10 is positioned in a side-by-side manner within the freezer. The anchors 97 provide a mechanical connection between the enclosure 90 and an inner wall of the freezer. One (1) embodiment (shown in FIG. 1) of the anchors 97 depicted takes the form of suction cups that are affixed to the wires of the front panel 92*a*. However, it should be understood that other means of attachment may be introduced as required.

Figure 5:
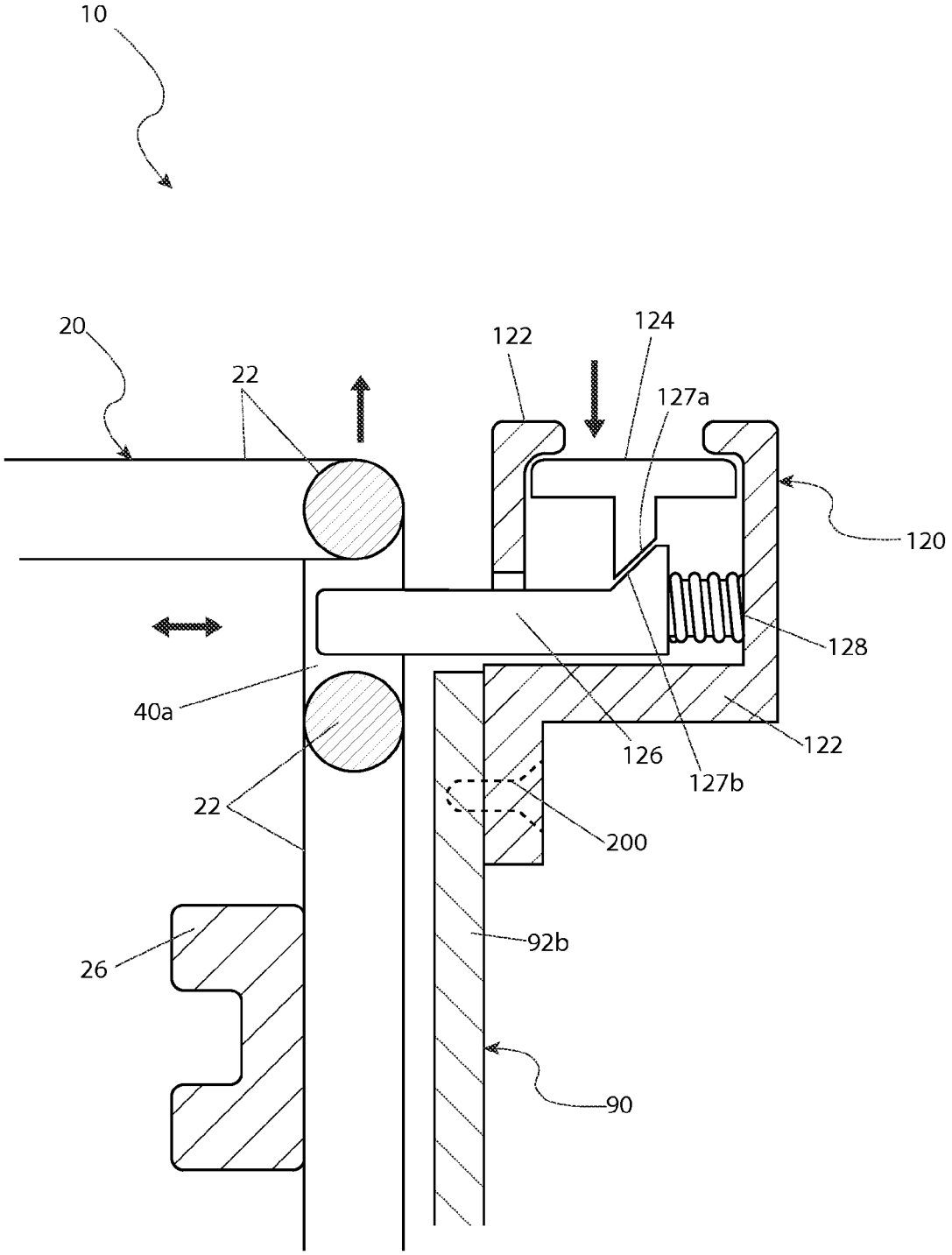
FIG. 5 is a sectional view of a latch assembly 120 of the elevating shelf system 10 taken along section line A-A of FIG. 1; and, FIG. 6 is a sectional view of a strut used in the elevating shelf system 10 taken along section line B-B of see FIG. 1.

Referring now primarily to FIGS. 1 and 5, the first side panel 92*b* of the enclosure 90 has an attached latch assembly 120 which allows a user to lock the shelf assembly 20 when raised position. The latch assembly 120 provides a mechanical connection between the enclosure 90 and the frame 22 of the shelf assembly 20. To that end the frame 22 of the shelf assembly 20 includes a first latch aperture 40*a* and a second latch aperture 40*b* along a side of the frame 22 for receiving the latch assembly 120. The latch apertures 40*a*, 40*b* are vertically aligned rectangular openings at the top and bottom of the frame 22. They enable securing the shelf assembly 20 using the latch assembly when the shelf assembly 20 is completely raised or lowered. It addition to using the first latch aperture 40*a* or the second latch aperture 40*b* a user may engage the latch assembly 120 to a bracket 26 to secure the shelf assembly 20 at intermediate positions.

The shelf assembly 20 also includes a top-mounted "U"-shaped handle 32 to aid in raising and lowering the shelf assembly 20. The handle 32 is integrally-molded or otherwise affixed to the top panel 28*a* of the shelf assembly 20. In use, a user grasps the handle 32 and lifts the shelf assembly 20 upward to expose a desired number of shelves 24. The user then locks the shelf assembly 20 in the raised position using the latch assembly 120.

Figure 2A:
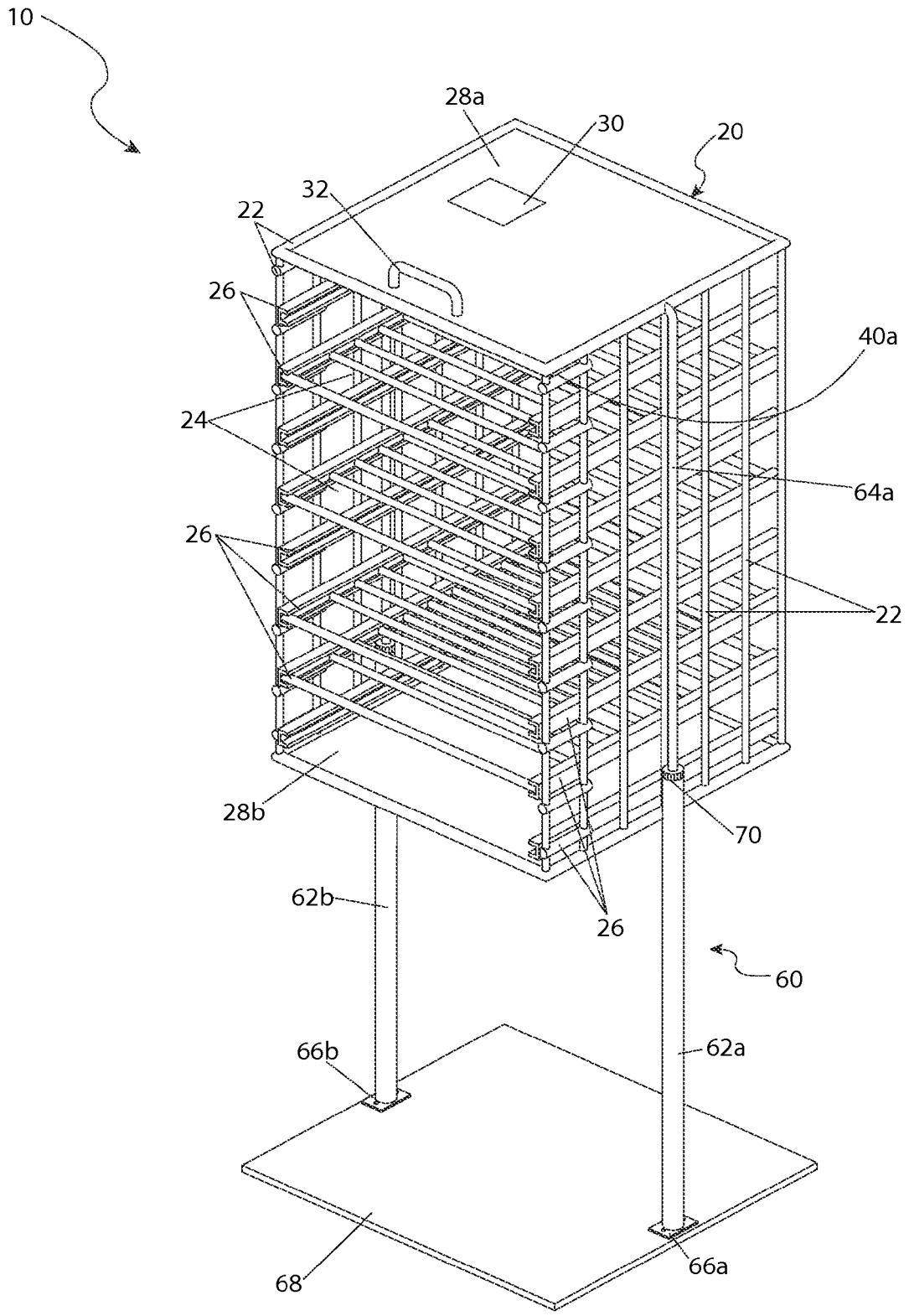
FIG. 2*a* is a front perspective view of a shelf assembly 20 and a lifting assembly 60 of the elevating shelf system 10 depicted in a raised state.
Figure 2B:
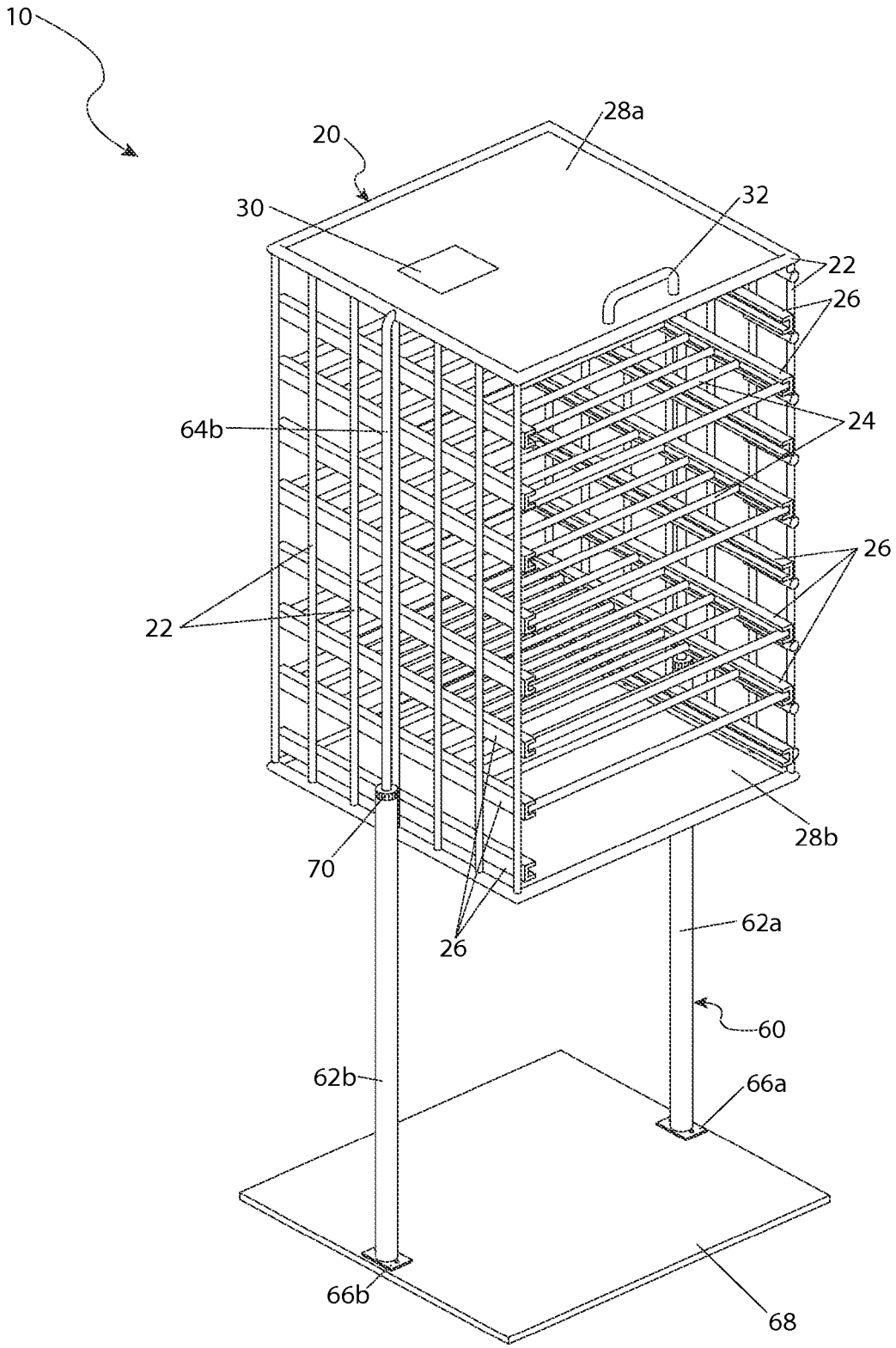
FIG. 2*b* is a rear perspective view of the shelf assembly 20 and the lifting assembly 60 shown in FIG. 2*a;*
Figure 3:
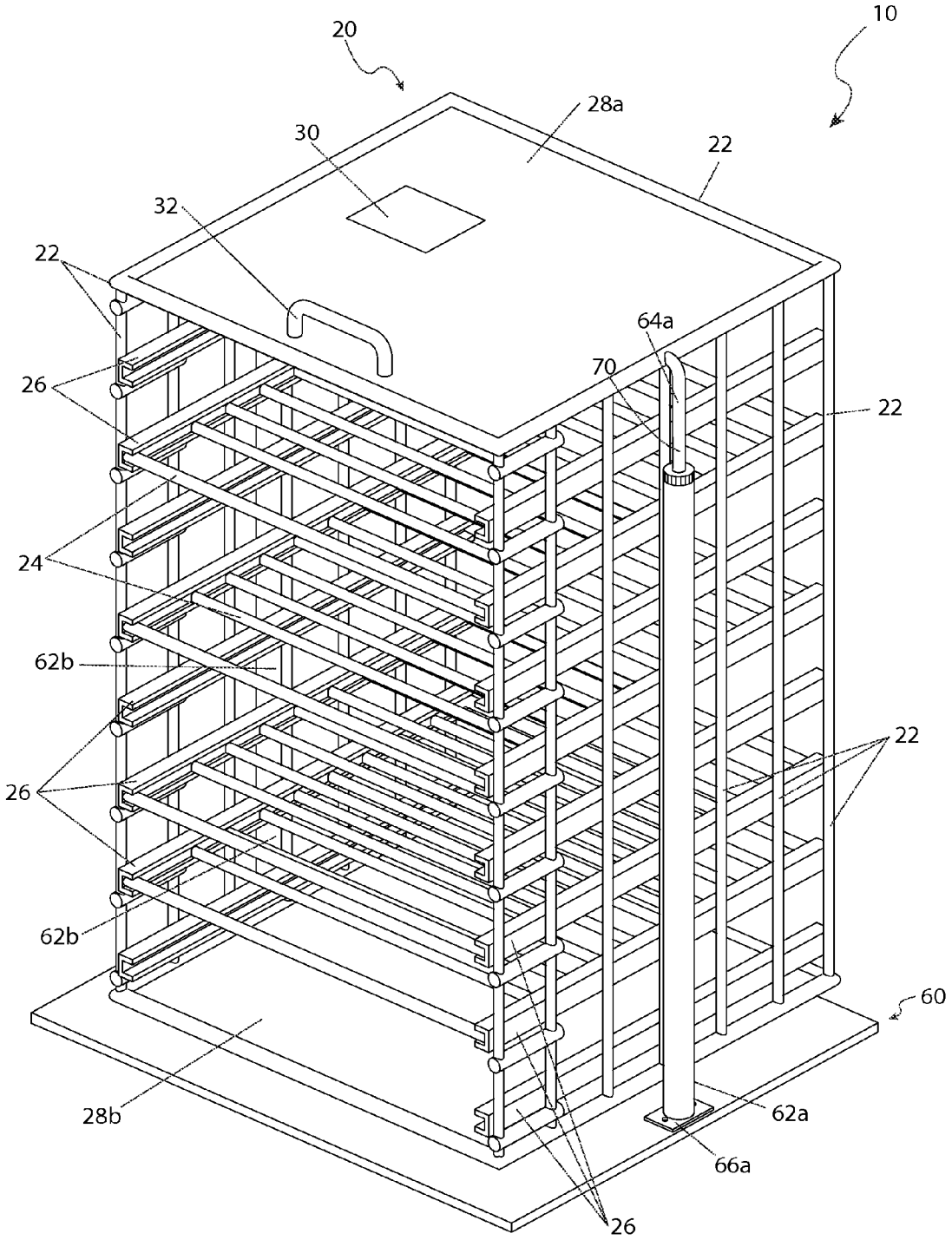
FIG. 3 is a front perspective view of the shelf assembly 20 and the lifting assembly 60 of FIGS. 2*a* and 2*b* depicted in a lowered state.

Refer now to FIGS. 2*a*, 2*b*, and 3 for various perspective views of the shelf assembly 20 and the lifting assembly 60 of the elevating shelf system 10 with the enclosure 90 removed for improved clarity. The lifting assembly 60 enables lifting the shelf assembly 20 upwardly approximately thirty inches (30 in.) along the first strut 62*a* and the second strut 62*b*. While the illustrated struts 62*a*, 62*b* include internal pneumatic dampening and spring-loaded features other types of strut mechanisms may be introduced which also provide an equivalent lifting force without deviating from the teachings of the elevating shelf system 10. The struts 62*a*, 62*b* respectively include an upwardly extending first strut shaft 64*a* and an upwardly extending second strut shaft 64*b* which provide permanent attachment at the top of the frame 22 of the shelf assembly 20 such as by welding or another type of permanent attachment.

The lifting assembly 60 further includes a rectangular lift base 68 which provides stability as well as an attachment for the struts 62*a*, 62*b* via respective an integral first mounting foot 66*a* and an integral second mounting foot 66*b*. The first mounting foot 66*a* and the second mounting foot 66*b* rigidly position the struts 62*a*, 62*b* vertically.

The struts 62*a*, 62*b* further include friction collars 70. The friction collars 70 enable an adjustably controlled ascent and descent of the strut shafts 64*a*, 64*b* which results in smooth vertical motion of the shelf assembly 20. Each friction collar 70 is located along a top edge of a strut 62*a*, 62*b* where the strut shafts 64*a*, 64*b* exit the struts 62*a*, 62*b*. Each friction collar 70 may be manually rotated to produce a tightening effect around the strut shaft 64*a*, 64*b* to increase applied friction. The friction collars 70 enable a user to selectively compensate for different foodstuff loading scenarios.

Figure 4:
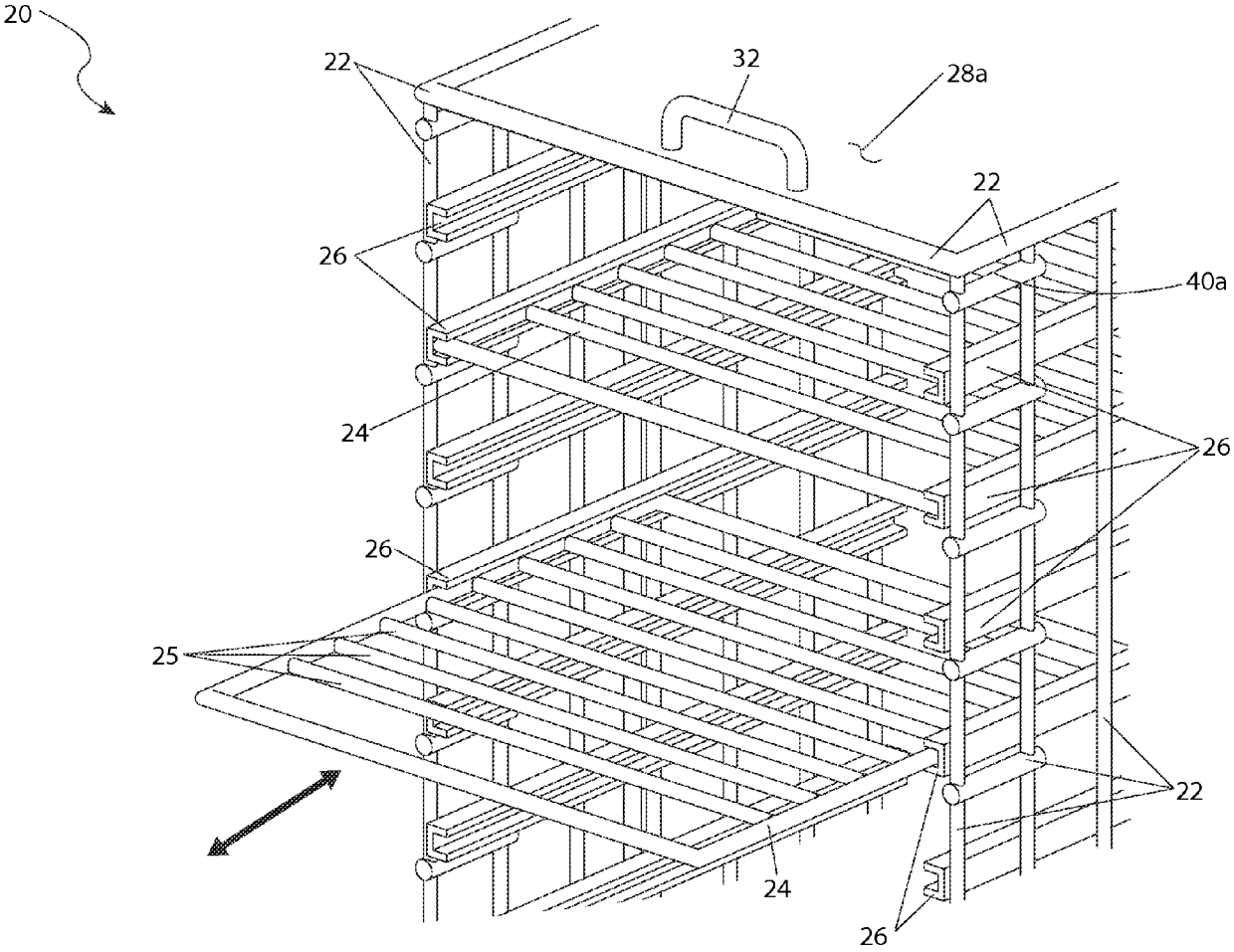
FIG. 4 is a close-up view of a shelf 24 of the elevating shelf system 10 depicted in an extended state.

Referring now to FIG. 4, the shelf assembly 20 provides a plurality of horizontally sliding shelves 24 and channel-shaped brackets 26 that are stacked within the frame 22. The shelves 24 are envisioned as being made of welded wire, molded or extruded plastic panels, or equivalent materials, having a plurality of equidistantly spaced cross-members 25 and capable of supporting a quantity of foodstuffs. The shelves 24 have rectangular outlines and may be moved in and out of the brackets 26 to enable access to the foodstuffs they hold. Each shelf 24 travels within a pair of the brackets 26 which are horizontally welded to opposing inner surfaces of the frame 22. The frame 22 is envisioned as providing a sufficient number of pairs of equally-spaced brackets 26 to enable selective installation of a desired number of shelves 24. This allows the shelf assembly 20 to retain both large and small foodstuffs.

Refer now to FIG. 5 for a sectional view of the latch assembly 120 taken along section line A-A of FIG. 1. As previously noted the latch assembly 120 enables securing the shelf assembly at a desired height. The embodiment of the latch assembly 120 illustrated in FIG. 5 includes a push-button 124 release that allows the latch assembly 120 to engage the frame 22, bracket 26, or latch aperture 40*a*, 40*b*. Upon pressing the push-button 124 downward the shelf assembly 20 is free to move vertically while being supported by the struts 62*a*, 62*b*. Once the shelf assembly 20 is positioned at a desired position, the push-button 124 is released and the shelf assembly 20 is locked in position.

The latch assembly 120 includes a box-shaped latch housing 122 that is attached to the first side panel 92*b* using a plurality of fasteners 200 such as screws or bolts. The latch housing 122 contains and guides the push-button 124 which in turn includes an inclined first cam 127*a* along its bottom. The latch housing 122 also contains a lock-bolt 126 having a corresponding second cam 127*b* along its top. As the push-button 124 is pressed downward the first cam 127*a* acts upon the second cam 127*b* to horizontally retract the lock-bolt 126, thereby allowing the user to move the shelf assembly 20 vertically. Upon releasing the push-button 124 a compression spring 128 acting upon the lock-bolt 126 returns the lock-bolt 126 to its extended and engaged position. However, it is envisioned that other styles and configurations of the latch assembly 120 which act to secure the shelf assembly 20 can be incorporated into the teachings of the elevating shelf system 10, and the particular embodiment shown and described herein is for purposes of clarity and disclosure and not by way of limitation of scope.

Figure 6:
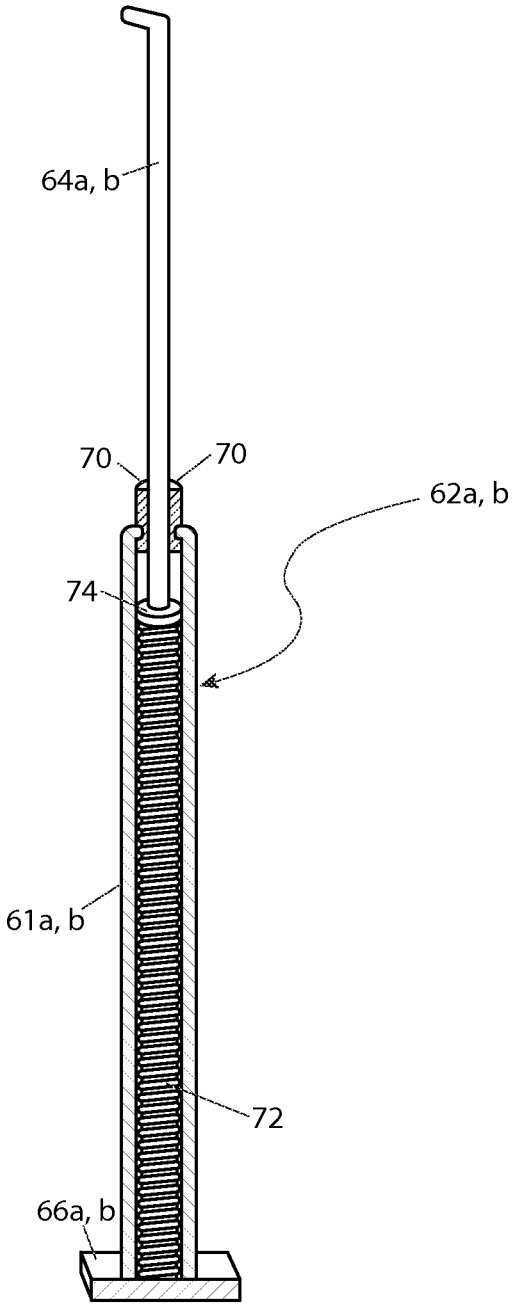

Referring now to FIG. 6, a sectional view of the struts of the elevating shelf system 10 taken along section line B-B of FIG. 1. The lifting assembly 60 (see for example FIGS. 1 and 2*a*) supports elevating the shelf assembly 20 upwardly approximately thirty inches (30 in.). The lifting assembly 60 includes a first strut 62*a* and a second strut 62*b*. The struts 62*a*, 62*b* respectively include a first strut tube 61*a*, a second strut tube 61*b*, a first mounting foot 66*a*, a second mounting foot 66*b*, and upwardly extending first strut shaft 64*a* and second strut shaft 64*b*. The tops of the strut shafts 64*a*, 64*b* enable permanent attachment to the frame 22 of the shelf assembly 20 using welding or another suitable fastening method. The strut tubes 61*a*, 61*b* include internal spring-loaded lifting mechanisms which include a strut spring 72 and a strut piston 74. The strut pistons 74 are positioned within the strut tube 61*a*, 61*b* and are permanently mounted to the bottom end of each strut shaft 64*a*, 64*b*. The strut springs 72 are compression-type springs acting between the associated strut piston 74 and mounting foot 66*a*, 66*b* to lift the frame 22.

The preferred embodiment of the present invention can be utilized by the common user in a simple and effortless manner with little or no training. After initial purchase or acquisition of the elevating shelf system 10, it would be installed as indicated in FIG. 1. The method of installing and utilizing the elevating shelf system 10 may be achieved by: procuring at least one (1) unit of the elevating shelf system 10; placing the elevating shelf system 10 within a chest freezer adjacent to a forward wall of the freezer; attaching the anchors 97 to inner surfaces of the freezer to stabilize the elevating shelf system 10; pressing the release push-button 124; adjusting the friction collars 70 on each strut 62*a*, 62*b* until a desired vertical motion of the shelf assembly 20 is obtained; positioning the shelf assembly 20 to a desired position for foodstuff loading by grasping the handle 32 to move the shelf assembly 20 as needed; releasing the push-button 124 to engage the lock-bolt 126 against brackets 26 or into the second latch aperture 40*b*, as desired; installing a desired number of shelves 124 into particular bracket portions 26 of the shelf assembly 20 so as to provide sufficient clearance between adjacent shelves 24 for the intended foodstuffs; grasping a forward edge of one (1) shelf 24 and extending it outward to a cantilevered position; loading a desired amount of foodstuffs onto the shelf 24; pushing the shelf 24 loaded with foodstuffs inward; repeating the positioning of the shelf assembly 20 and loading of foodstuffs onto remaining shelves 24, as desired, until all the foodstuffs are loaded onto the shelf assembly 20; releasing and lowering the shelf assembly 20 by pressing the push-button portion 124 of the latch assembly 120; pressing downwardly upon the handle 32, as needed, to lower the shelf assembly 20 completely to the bottom position within the enclosure 90; securing the shelf assembly 20 in the lowered position by releasing the push-button 124 to engage the lock-bolt 126 into the first latch aperture 40*a*; noting the type and location of foodstuffs loaded within the shelf assembly 20 onto a card, a dry-erase board, or similar media stored within the plastic sleeve 30; placing the completed inventory card within the plastic sleeve 30 located upon the top panel 28*a* for future reference; installing additional units of the elevating shelf system 10 in the chest freezer in like manner, based upon available space, as desired; attaching the units of the elevating shelf system 10 using the joining clips 95; stabilizing each unit of the elevating shelf system 10 within the freezer by attaching the anchor portions 97 of the front panel 92*a* to inner surfaces of the freezer; and, benefiting from reduced stress and strain associated with manual loading and unloading of foodstuffs within a chest-type freezer, afforded a user of the present invention 10.

It is understood that additional units of the elevating shelf system 10 may be positioned adjacent to the first unit of the elevating shelf system 10, space permitting, and the respective enclosures 90 joined together for additional stabilization using the joining clip 95 of the respective enclosures 90.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An elevating shelf system, comprising:

a shelf assembly having:

a welded metal wire frame forming surfaces along three sides;

a top panel attached to a top of said frame, further having a handle on a top thereof;

a bottom panel attached to a bottom of said frame;

at least two brackets attached within said frame; and, a transparent inventory holder affixed to said top panel for retaining an inventory of items in said elevating shelf system;

an extendable shelf held by said at least two brackets;

an enclosure for receiving said shelf assembly; and, a lifting assembly operatively connected to said shelf assembly and to said enclosure;

wherein said shelf assembly can be raised or lowered within said enclosure; and, wherein said lifting assembly imparts an upward vertical force on said shelf assembly.

2. The elevating shelf system of claim 1, wherein said top panel and said bottom panel are solid, flat plates.

3. The elevating shelf system of claim 1, wherein said shelf assembly is an open-front, five-sided box.

4. The elevating shelf system of claim 1, wherein said at least two brackets are channel-shaped and wherein said extendable shelf is held within said channels.

5. The elevating shelf system of claim 1, wherein said enclosure is comprised of welded metal wire.

6. The elevating shelf system of claim 5, wherein said enclosure is a five sided open-top box having a base.

7. The elevating shelf system of claim 6, wherein said lifting assembly includes at least one, elongated and vertically orientated spring loaded strut that imparts an upward force on said shelf assembly.

8. The elevating shelf system of claim 7, wherein said enclosure includes at least one side panel having a semi-circular strut guard which partially encircles said at least one strut.

9. The elevating shelf system of claim 7, wherein said lifting assembly further includes a lift base attached to the bottom of said at least one strut.

10. The elevating shelf system of claim 7, wherein said at least one strut includes a manually adjustable friction collar for enabling an adjustable controlled ascent and descent of said shelf assembly.

11. The elevating shelf system of claim 7, wherein said at least one strut includes a first strut tube having an internal spring, a second strut tube having a strut piston, a first mounting foot attached to said base and a second mounting foot attached to said shelf assembly.

12. The elevating shelf system of claim 6, further including at least one anchor for connecting said enclosure to an interior wall of a chest freezer.

13. The elevating shelf system of claim 12, wherein said anchor includes a suction cup assembly having a suction cup for attaching to the interior wall and a connector for connecting to said enclosure.

14. The elevating shelf system of claim 6, further including at least one clip for connecting said enclosure to an adjacent enclosure.

15. The elevating shelf system of claim 14, wherein said clip is a "J"-shaped appendage.

16. The elevating shelf system of claim 1, further including a latch assembly having a housing attached to said enclosure, said latch assembly further including a movable lock-bolt passing through said housing and into said frame, said latch assembly for securing said shelf assembly at a desired height.

17. The elevating shelf system of claim 16, wherein said lock-bolt is spring biased toward said shelf assembly.

* * * * *